US012398644B2

(12) United States Patent
Shteyman et al.

(10) Patent No.: US 12,398,644 B2
(45) Date of Patent: Aug. 26, 2025

(54) MANIFOLD FOR TURBINE BLADE OF GAS TURBINE ENGINE

(71) Applicant: Siemens Energy Global GmbH & Co. KG, Munich (DE)

(72) Inventors: Yevgeniy P. Shteyman, West Palm Beach, FL (US); Phillip W. Gravett, Orlando, FL (US); Stephen Williamson, McAdenville, NC (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 18/335,206

(22) Filed: Jun. 15, 2023

(65) Prior Publication Data

US 2024/0068368 A1 Feb. 29, 2024

Related U.S. Application Data

(60) Provisional application No. 63/359,501, filed on Jul. 8, 2022.

(51) Int. Cl.
*F01D 5/08* (2006.01)
*F01D 5/18* (2006.01)

(52) U.S. Cl.
CPC ..... *F01D 5/087* (2013.01); *F01D 5/187* (2013.01)

(58) Field of Classification Search
CPC ..... F01D 5/081; F01D 5/085; F01D 5/087; F01D 5/088; F01D 5/187
See application file for complete search history.

(56) References Cited

U.S. PATENT DOCUMENTS 10,094,228 B2 * 10/2018 Jendrix ..... F01D 5/3007
2004/0115054 A1 * 6/2004 Balland ..... F01D 5/18 416/97 R
2007/0212228 A1 * 9/2007 Digard Brou De Cuissart ..... F01D 5/187 416/97 R
2023/0003134 A1 * 1/2023 Tsypkaykin ..... F01D 5/147

FOREIGN PATENT DOCUMENTS

EP 3241988 A1 * 11/2017
FR 2978078 A1 * 1/2013 ..... B23K 26/242

OTHER PUBLICATIONS

Carlin, Machine Translation of FR2978078, 2013 (Year: 2013).*

* cited by examiner

*Primary Examiner* — Courtney D Heinle
*Assistant Examiner* — Michael K. Reitz

(57) ABSTRACT

A turbine blade includes a platform, a blade airfoil attached to one side of the platform, a blade root attached to the other side of the platform, a manifold attached to the blade root. The blade root defines a first cooling passage and a second cooling passage. The manifold includes an outer wall, a first compartment having a first flow area defined by a first aperture formed at the outer wall, and a second compartment having a second flow area defined by a second aperture formed at the outer wall. The first compartment meters a non-zero first flow of cooling air to the first cooling passage through the first flow area. The second compartment meters a non-zero second flow of cooling air to the second cooling passage through the second flow area that is different than the first flow area.

6 Claims, 5 Drawing Sheets

MANIFOLD FOR TURBINE BLADE OF GAS TURBINE ENGINE

BACKGROUND

A gas turbine engine typically includes a compressor section, a turbine section, and a combustion section disposed therebetween. The compressor section includes multiple stages of rotating compressor blades and stationary compressor vanes. The combustion section typically includes a plurality of combustors. The turbine section includes multiple stages of rotating turbine blades and stationary turbine vanes. Turbine blades and turbine vanes often operate in a high temperature environment and are internally cooled.

BRIEF SUMMARY

In one aspect, a turbine blade includes a platform defining a first side and a second side. The turbine blade also includes a blade airfoil attached to the first side of the platform, the blade airfoil includes a pressure side wall and a suction side wall defining a blade airfoil interior. The turbine blade also includes a blade root attached to the second side of the platform, the blade root including a blade root leading edge and a blade root trailing edge with respect to a flow direction of a working flow, the blade root defining a first cooling passage and a second cooling passage that are in flow communication with the blade airfoil interior. The turbine blade also includes a manifold attached to the blade root, the manifold being non-planar, the manifold includes an outer wall, a first compartment having a first flow area defined by a first aperture, the first aperture being formed at the outer wall and open to the first compartment, the first compartment metering a non-zero first flow of cooling air to the first cooling passage through the first flow area, and a second compartment having a second flow area defined by a second aperture, the second aperture being formed at the outer wall and open to the second compartment, the second compartment metering a non-zero second flow of cooling air to the second cooling passage through the second flow area that is different than the first flow area.

In one aspect, a manifold for use with a turbine blade, the manifold includes a first side plate, a second side plate, an outer plate that extends between the first side plate and the second side plate, a forward plate attached to the first side plate, the second side plate, and the outer plate at one end, an aft plate attached to the first side plate, the second side plate, and the outer plate at the other side that is opposite to the one end, a first compartment having a first flow area defined by a first aperture, the first aperture being formed at the first side plate and open to the first compartment, a second compartment having a second flow area defined by a second aperture, the second aperture being formed at the first side plate and open to the second compartment, the second flow area being different than the first flow area.

In one aspect, a manifold for use with a turbine blade, the manifold includes a first compartment having a first compartment outer wall, the first compartment outer wall defining a first aperture that is open to the first compartment, the first aperture defining a first flow area, and a second compartment having a second compartment outer wall, the second compartment outer wall defining a second aperture that is open to the second compartment, the second aperture defining a second flow area that is different than the first flow area.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
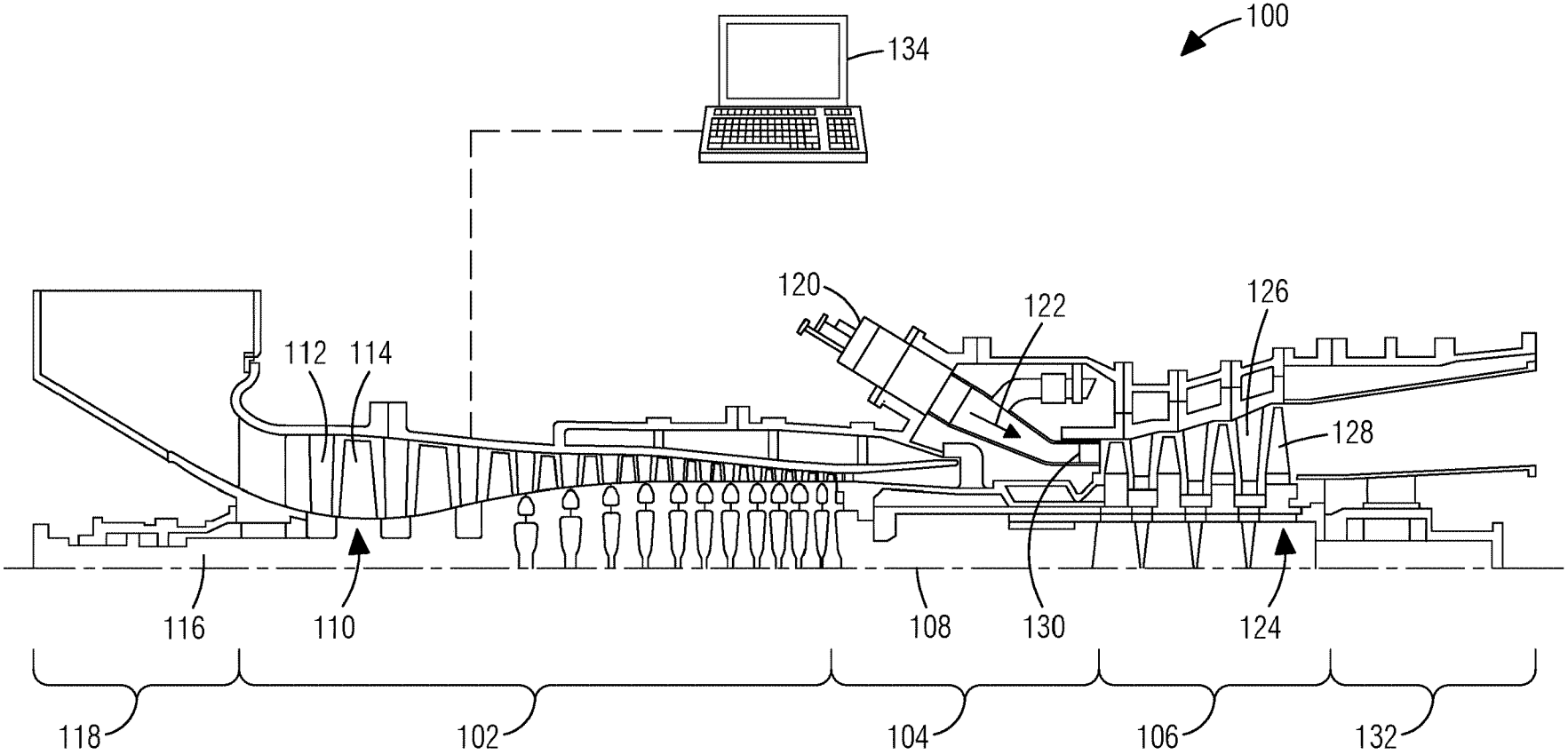
FIG. 1 is a longitudinal cross-sectional view of a gas turbine engine taken along a plane that contains a longitudinal axis or central axis.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including", "having", and "comprising", as well as derivatives thereof, mean inclusion without limitation. The singular forms "a", "an", and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith" as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, in the description, the terms "axial" or "axially" refer to a direction along a longitudinal axis of a gas turbine engine. The terms "radial" or "radially" refer to a direction perpendicular to the longitudinal axis of the gas turbine engine. The terms "downstream" or "aft" refer to a direction along a flow direction. The terms "upstream" or "forward" refer to a direction against the flow direction.

In addition, the term "adjacent to" may mean that an element is relatively near to but not in contact with a further element; or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates an example of a gas turbine engine 100 including a compressor section 102, a combustion section 104, and a turbine section 106 arranged along a central axis 112. The compressor section 102 includes a plurality of compressor stages 114 with each compressor stage 114 including a set of stationary compressor vanes 116 or adjustable guide vanes and a set of rotating compressor blades 118. A rotor 134 supports the rotating compressor blades 118 for rotation about the central axis 112 during operation. In some constructions, a single one-piece rotor 134 extends the length of the gas turbine engine 100 and is supported for rotation by a bearing at either end. In other constructions, the rotor 134 is assembled from several separate spools that are attached to one another or may include multiple disk sections that are attached via a bolt or plurality of bolts.

The compressor section 102 is in fluid communication with an inlet section 108 to allow the gas turbine engine 100 to draw atmospheric air into the compressor section 102. During operation of the gas turbine engine 100, the compressor section 102 draws in atmospheric air and compresses that air for delivery to the combustion section 104. The illustrated compressor section 102 is an example of one compressor section 102 with other arrangements and designs being possible.

In the illustrated construction, the combustion section 104 includes a plurality of separate combustors 120 that each operate to mix a flow of fuel with the compressed air from the compressor section 102 and to combust that air-fuel mixture to produce a flow of high temperature, high pressure combustion gases or exhaust gas 122. Of course, many other arrangements of the combustion section 104 are possible.

The turbine section 106 includes a plurality of turbine stages 124 with each turbine stage 124 including a number of stationary turbine vanes 126 and a number of rotating turbine blades 128. The turbine stages 124 are arranged to receive the exhaust gas 122 from the combustion section 104 at a turbine inlet 130 and expand that gas to convert thermal and pressure energy into rotating or mechanical work. The turbine section 106 is connected to the compressor section 102 to drive the compressor section 102. For gas turbine engines 100 used for power generation or as prime movers, the turbine section 106 is also connected to a generator, pump, or other device to be driven. As with the compressor section 102, other designs and arrangements of the turbine section 106 are possible.

An exhaust portion 110 is positioned downstream of the turbine section 106 and is arranged to receive the expanded flow of exhaust gas 122 from the final turbine stage 124 in the turbine section 106. The exhaust portion 110 is arranged to efficiently direct the exhaust gas 122 away from the turbine section 106 to assure efficient operation of the turbine section 106. Many variations and design differences are possible in the exhaust portion 110. As such, the illustrated exhaust portion 110 is but one example of those variations.

A control system 132 is coupled to the gas turbine engine 100 and operates to monitor various operating parameters and to control various operations of the gas turbine engine 100. In preferred constructions the control system 132 is typically micro-processor based and includes memory devices and data storage devices for collecting, analyzing, and storing data. In addition, the control system 132 provides output data to various devices including monitors, printers, indicators, and the like that allow users to interface with the control system 132 to provide inputs or adjustments. In the example of a power generation system, a user may input a power output set point and the control system 132 may adjust the various control inputs to achieve that power output in an efficient manner.

The control system 132 can control various operating parameters including, but not limited to variable inlet guide vane positions, fuel flow rates and pressures, engine speed, valve positions, generator load, and generator excitation. Of course, other applications may have fewer or more controllable devices. The control system 132 also monitors various parameters to assure that the gas turbine engine 100 is operating properly. Some parameters that are monitored may include inlet air temperature, compressor outlet temperature and pressure, combustor outlet temperature, fuel flow rate, generator power output, bearing temperature, and the like. Many of these measurements are displayed for the user and are logged for later review should such a review be necessary.

Figure 2:
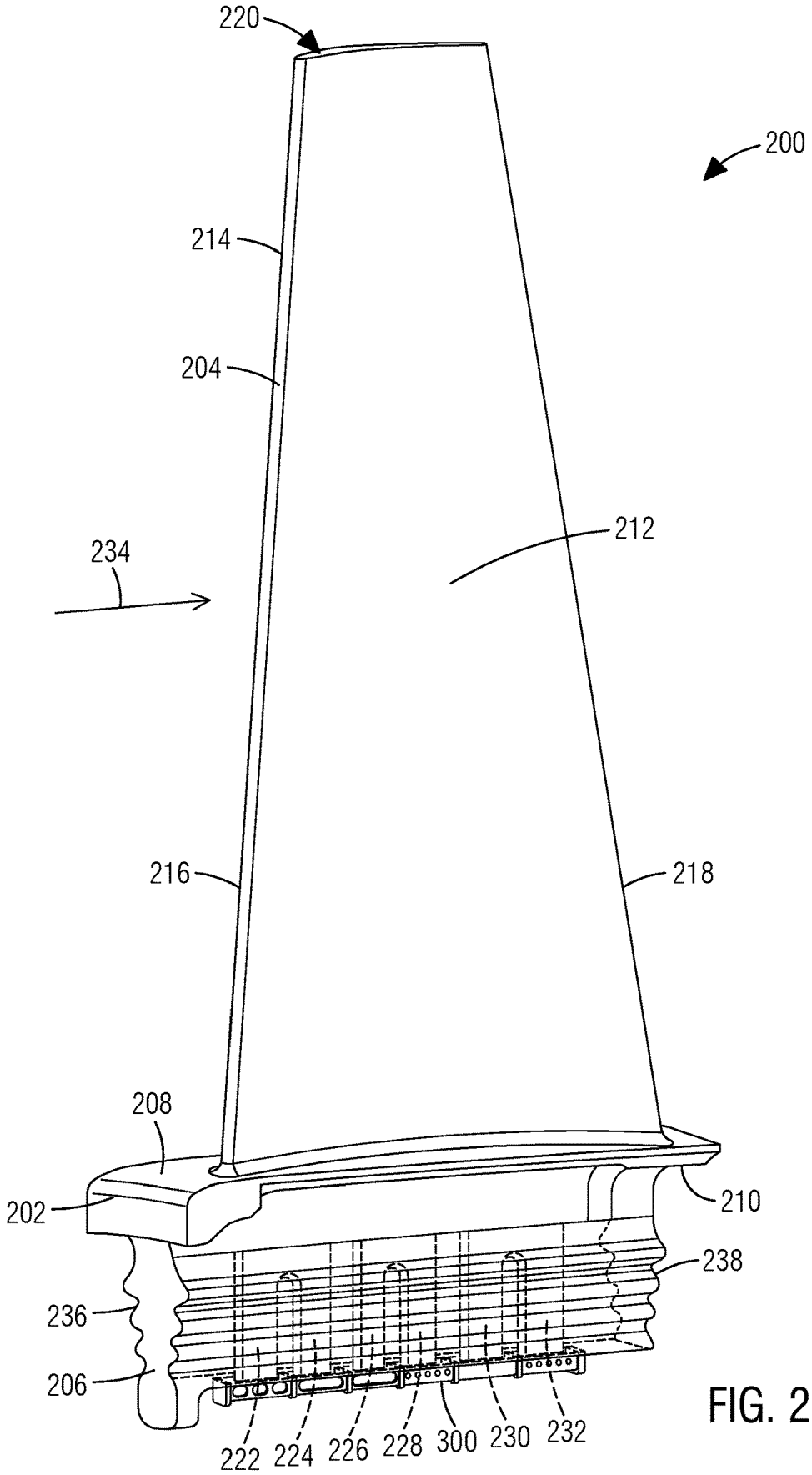
FIG. 2 is a perspective view of a turbine blade for use with the gas turbine engine shown in FIG. 1.

FIG. 2 illustrates a perspective view of a turbine blade 200 that can be used in the gas turbine engine 100 in FIG. 1. A plurality of the turbine blades 200 may replace the rotating turbine blades 128 or combine with the rotating turbine blades 128.

The turbine blade 200 includes a platform 202, a blade airfoil 204, and a blade root 206. The platform 202 has a first side 208 that faces away from the rotor 134 and a second side 210 that is opposite to the first side 208 and faces toward the rotor 134.

The blade airfoil 204 is attached to the platform 202 at the first side 208. The blade airfoil 204 has a pressure side wall 212 and a suction side wall 214. The pressure side wall 212 and the suction side wall 214 meet at a blade airfoil leading edge 216 and a blade airfoil trailing edge 218 with respect to a flow direction of a working flow 234. The working flow 234 may be the exhaust gas 122 from the combustion section 104. The pressure side wall 212 and the suction side wall 214 define a blade airfoil interior 220.

The blade root 206 is attached to the platform 202 at the second side 210. The blade root 206 has a blade root leading edge 236 and a blade root trailing edge 238 with respect to the flow direction of the working flow 234. The blade root 206 includes a plurality of cooling passages that are defined within the blade root 206. In the construction illustrated in FIG. 2, the blade root 206 includes six cooling passages including, from the blade root leading edge 236 to the blade root trailing edge 238, a first leading cooling passage 222, a second leading cooling passage 224, a first mid cooling passage 226, a second mid cooling passage 228, a first trailing cooling passage 230, and a second trailing cooling passage 232. The cooling passages extend to the platform 202 and are in flow communication with the blade airfoil interior 220 to provide cooling air to the plurality of cooling channels of the blade airfoil 204. In other constructions, the blade root 206 may have more or less than six cooling passages.

The turbine blade 200 includes a manifold 300 that is attached to the blade root 206 at a side facing to the rotor 134. The manifold 300 is non-planar and meters or controls the quantity of cooling air that flows to each cooling passage of the plurality of cooling passages or blocks the cooling air from entering at least one of the cooling passages.

Figure 3:
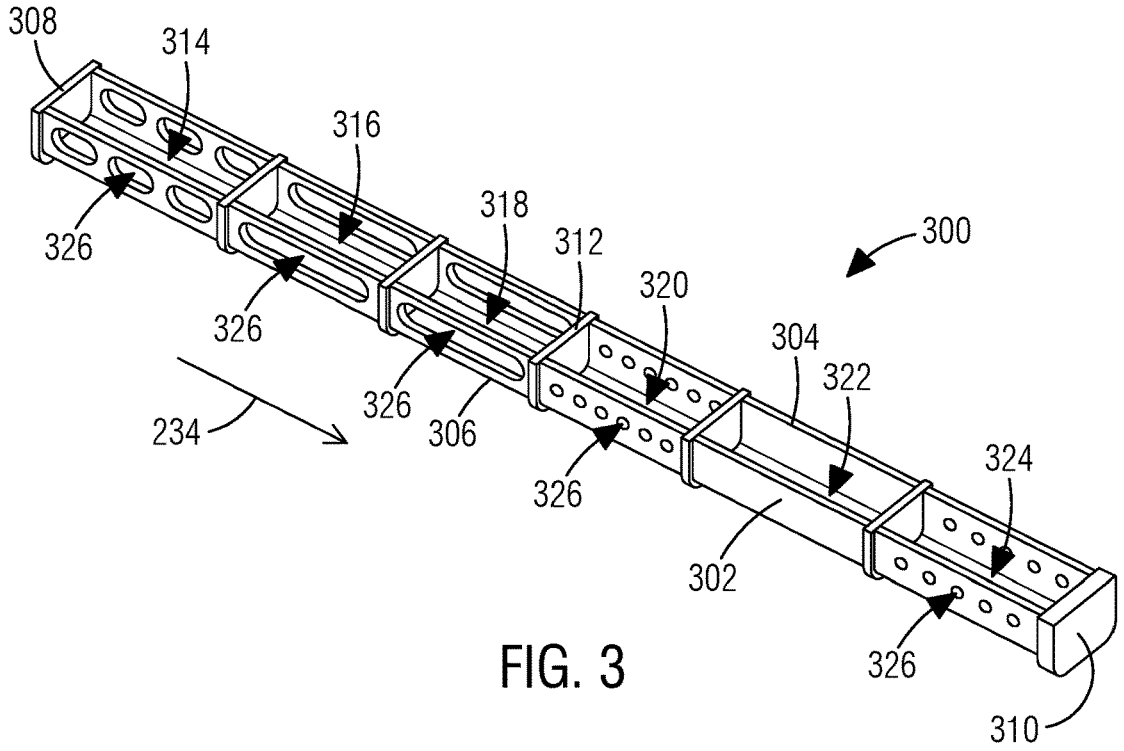
FIG. 3 is a perspective view of a manifold for use with the turbine blade shown in FIG. 2.

FIG. 3 illustrates the manifold 300 for use with the turbine blade 200 of FIG. 2. The manifold 300 includes an outer wall 328 that can be made up of one or more features, walls, or plates, which define the non-planar manifold 300. In the construction illustrated in FIG. 3, the outer wall 328 is made up of a first side plate 302, a second side plate 304, an outer plate 306, a forward plate 308, and an aft plate 310. The outer plate 306 is solid and extends between the first side plate 302 and the second side plate 304. The forward plate 308 is positioned at an upstream side with respect to the flow direction of the working flow 234. The forward plate 308 is perpendicular to the outer plate 306. The aft plate 310 is positioned at a downstream side with respect to the flow direction of the working flow 234. The aft plate 310 is perpendicular to the outer plate 306. The first side plate 302, the second side plate 304, the outer plate 306, the forward plate 308, and the aft plate 310 define a plenum therein. The forward plate 308, the aft plate 310, and the outer plate 306 are solid. A side that is opposite to the outer plate 306 is open and defines a perimeter having a planar surface that is attached to the blade root 206. The forward plate 308 is disposed at the blade root leading edge 236 and the aft plate 310 is disposed at the blade root trailing edge 238 once the manifold 300 is attached to the blade root 206.

The manifold 300 includes a plurality of divider plates 312 that divide the manifold 300 into a plurality of compartments. Each divider plate 312 of the plurality of divider plates 312 is solid and perpendicular to the outer plate 306. In the construction illustrated in FIG. 3, the manifold 300 includes five divider plates 312 that divide the manifold 300 into six compartments including, with respect to the flow direction of the exhaust gas 122, a first leading compartment 314, a second leading compartment 316, a first mid compartment 318, a second mid compartment 320, a first trailing compartment 322, and a second trailing compartment 324. In other constructions, the manifold 300 may have more or less than six compartments.

The first side plate 302 and the second side plate 304 define a plurality of apertures 326. In the construction shown in FIG. 3, the first side plate 302 defines three apertures 326 that are open to the first leading compartment 314. The second side plate 304 defines three apertures 326 that are open to the first leading compartment 314. The six apertures 326 in the first leading compartment 314 equally contribute to a flow area of the first leading compartment 314. The first side plate 302 defines one aperture 326 that is open to the second leading compartment 316. The second side plate 304 defines one aperture 326 that is open to the second leading compartment 316. The two apertures 326 in the second leading compartment 316 equally contribute a flow area of the second leading compartment 316. The first side plate 302 defines one aperture 326 that is open to the first mid compartment 318. The second side plate 304 defines one aperture 326 that is open to the first mid compartment 318. The two apertures 326 in the first mid compartment 318 equally contribute a flow area of the first mid compartment 318. The first side plate 302 defines six apertures 326 that are open to the second mid compartment 320. The second side plate 304 defines six apertures 326 that are open to the second mid compartment 320. The twelve apertures 326 in the second mid compartment 320 equally contribute a flow area of the second mid compartment 320. The first side plate 302 and the second side plate 304 in the first trailing compartment 322 includes no apertures 326. The first side plate 302 defines five apertures 326 that are open to the second trailing compartment 324. The second side plate 304 defines five apertures 326 that are open to the second trailing compartment 324. The ten apertures 326 in the second trailing compartment 324 equally contribute a flow area of the second trailing compartment 324. The flow areas of the compartments may be different from each other. In general, the flow areas of the compartments at the blade root leading edge 236 is larger than the flow areas of the compartments at the blade root trailing edge 238. Other constructions could include apertures 326 that extend through the outer wall 328 in any direction desired. For example, the apertures 326 may pass through the outer plate 306.

In the construction shown in FIG. 3, the flow area of the second leading compartment 316 is larger than the flow area of the first leading compartment 314, the flow area of the first mid compartment 318, the flow area of the second mid compartment 320, and the flow area of the second trailing compartment 324. The flow area of the first mid compartment 318 is larger than the flow area of the first leading compartment 314, the flow area of the second mid compartment 320, and the flow area of the second mid second trailing compartment 324. The flow area of the first leading compartment 314 is larger than the flow area of the second mid compartment 320 and the flow area of the second trailing compartment 324. The flow area of the second mid compartment 320 is larger than the flow area of the second trailing compartment 324.

In other constructions, each compartment may have different numbers of apertures 326 than the manifold 300 shown in FIG. 3. The flow area of each compartment may be different than the manifold 300 shown in FIG. 3. The geometries of the apertures 326 may be different than the geometries of the apertures 326 shown in FIG. 3.

Figure 4:
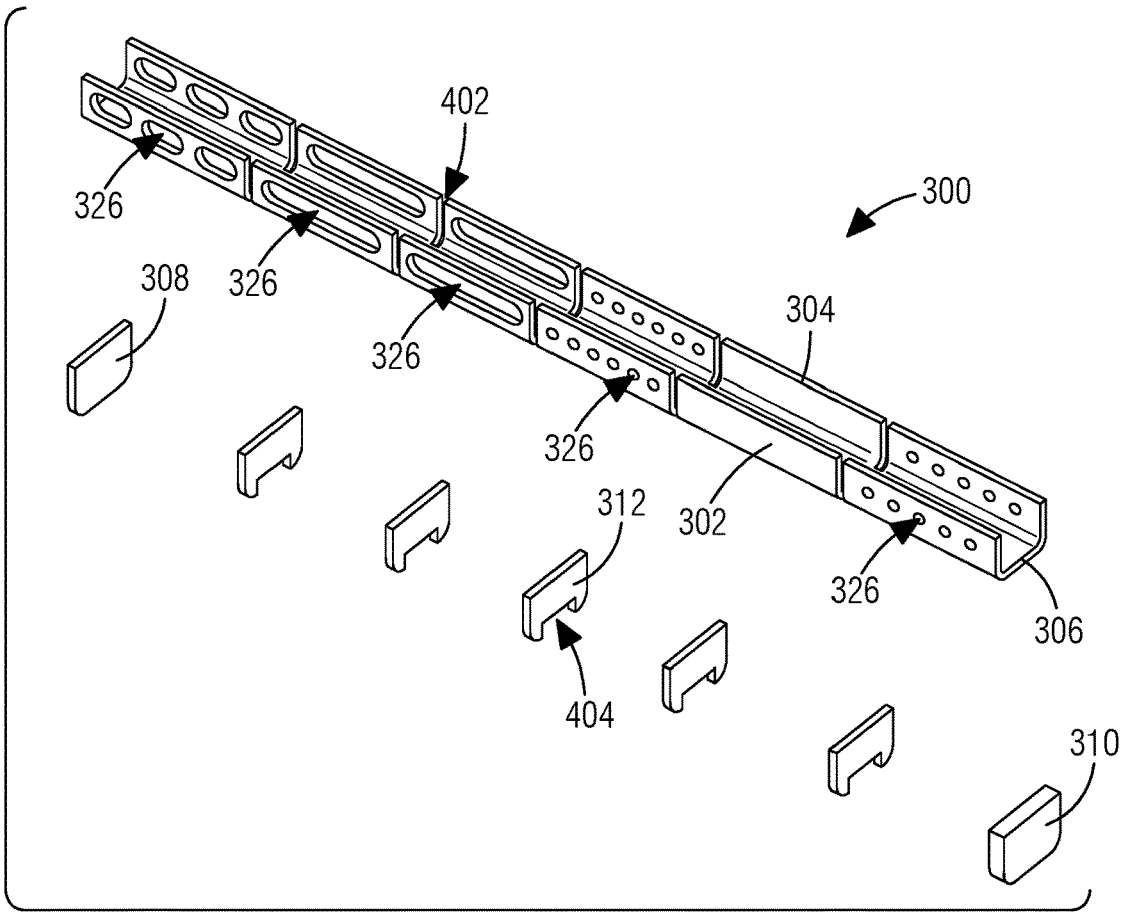
FIG. 4 is a perspective exploded view of the manifold shown in FIG. 3.

FIG. 4 illustrates a perspective exploded view of the manifold 300 shown in FIG. 3. A plurality of gaps 402 are formed in the first side plate 302 and the second side plate 304. The first side plate 302, the second side plate 304, and the outer plate 306 each have a generally rectangular shape. The first side plate 302 and the second side plate 304 perpendicularly extend from two sides of the outer plate 306. Each of the first side plate 302, the second side plate 304, and the outer plate 306 has rounded edges. The first side plate 302, the second side plate 304, and the outer plate 306 are formed as a single piece. In other constructions, the first side plate 302, the second side plate 304, and the outer plate 306 may be formed as separated pieces and assembled together.

The forward plate 308 has a general square shape having rounded edges. The forward plate 308 is perpendicularly welded or brazed to the first side plate 302, second side plate 304, and the outer plate 306.

The aft plate 310 has a general square shape having rounded edges. The aft plate 310 is perpendicularly welded or brazed to the first side plate 302, second side plate 304, and the outer plate 306. The aft plate 310 is thicker than the forward plate 308. In other constructions, the aft plate 310 may be thinner or equal to the forward plate 308.

Each divider plate 312 has a general square shape having rounded edges. Each divider plates 312 has a cutout 404 to engage with the outer plate 306. Each divider plate 312 is inserted into one of the gaps 402 and welded or brazed to the first side plate 302, the second side plate 304, and the outer plate 306.

Figure 5:
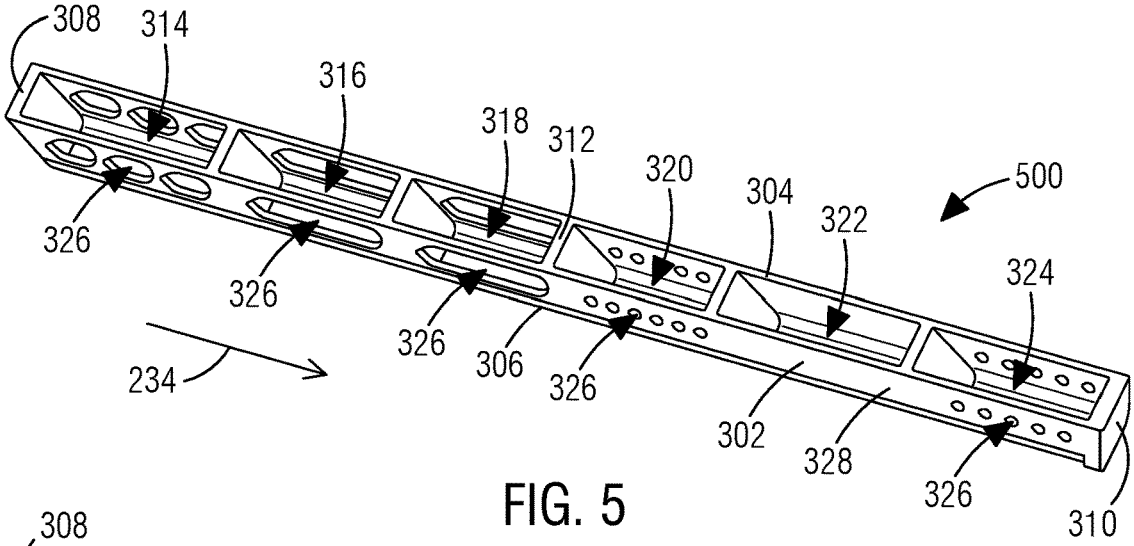
FIG. 5 is a perspective view of a manifold suitable for use with the turbine blade shown in FIG. 2.

FIG. 5 illustrates a perspective view of a manifold 500 suitable for use with the turbine blade 200 shown in FIG. 2. The manifold 500 may replace the manifold 300 shown in FIG. 2.

In the construction shown in FIG. 5, the forward plate 308 and the divider plate 312 are oblique to the outer plate 306. It is also possible that the aft plate 310 is oblique to the outer plate 306. It is also possible that is oblique to the outer plate 306. The manifold 500 may be manufactured as a single piece using methods, such as additive manufacture. The manifold 500 otherwise has the similar configuration as the manifold 300.

Figure 6:
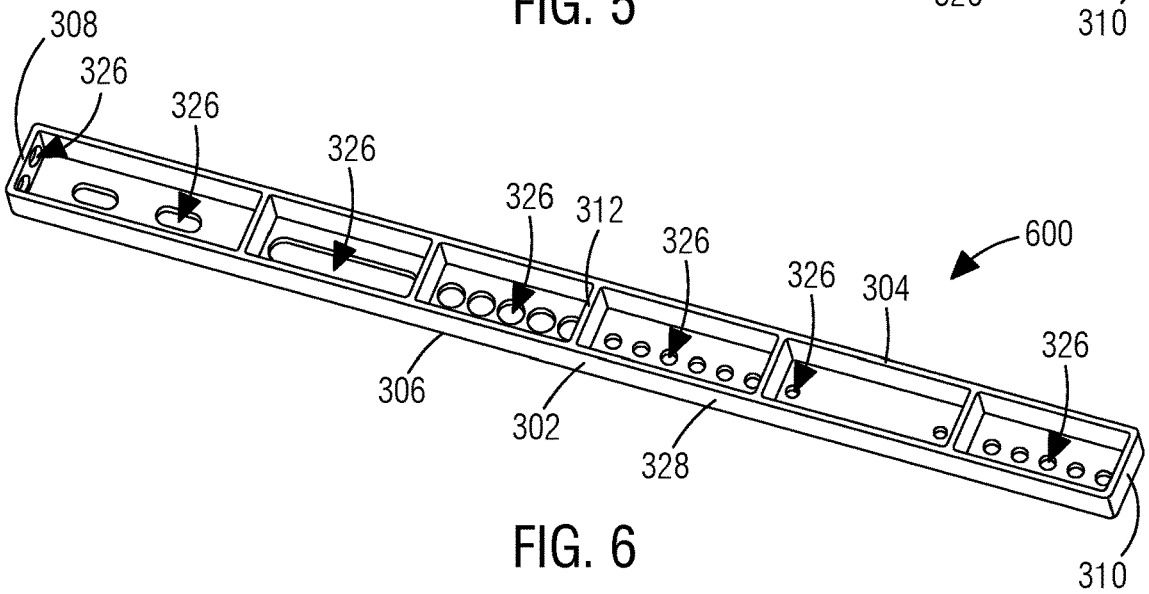
FIG. 6 is a perspective view of a manifold suitable for use with the turbine blade shown in FIG. 2.

FIG. 6 illustrates a perspective view of a manifold 600 suitable for use with the turbine blade 200 shown in FIG. 2. The manifold 600 may replace the manifold 300 shown in FIG. 2.

In the construction shown in FIG. 6, the apertures 326 are formed at the outer plate 306 and the forward plate 308. It is also possible that the apertures 326 are formed at the aft plate 310. The manifold 500 otherwise has the similar configuration as the manifold 300.

Figure 7:
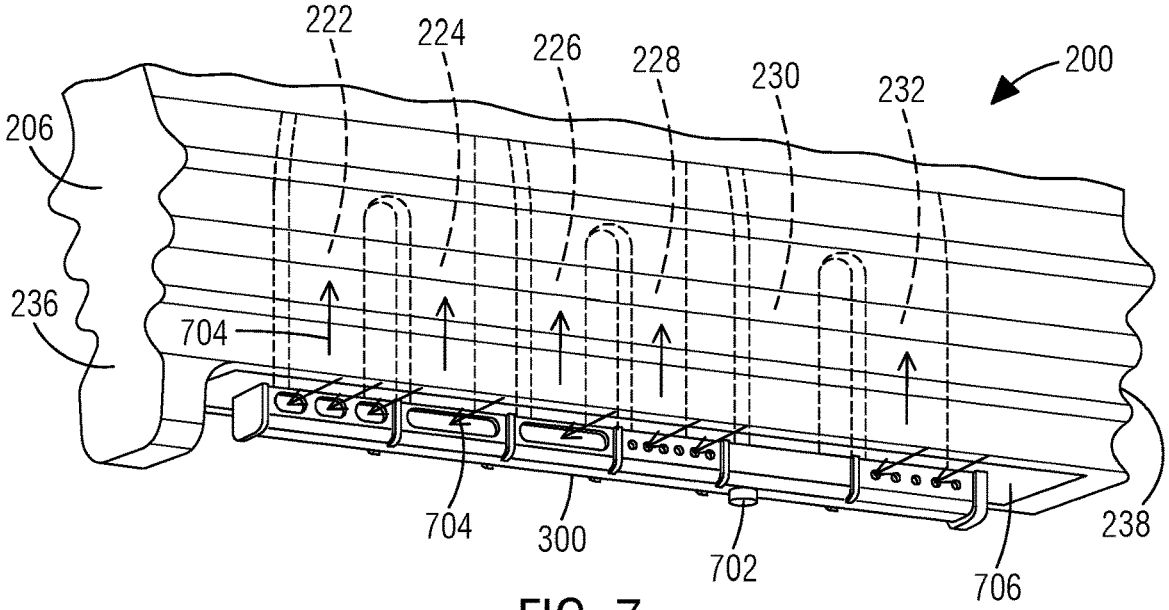
FIG. 7 is portion of a perspective view of the turbine blade shown in FIG. 2 that better illustrates the blade root and the manifold shown in FIG. 3.

FIG. 7 illustrates a portion of a perspective view of the turbine blade 200 shown in FIG. 2 that better illustrates the blade root 206 and the manifold 300. The manifold 300 is aligned with the blade root 206 with a position pin 702 that is inserted into the blade root 206. The position pin 702 is inserted into the blade root 206 through the first trailing compartment 322. The manifold 300 is perimeter welded to a blade root end surface 706 all around, using, for example, a fillet weld. The outer plate 306 is spaced a non-zero distance away from the blade root end surface 706.

IG. 8 illustrates a perspective view of a manifold 800 suitable for use with the turbine blade 200 shown in FIG. 2.

Figure 8:
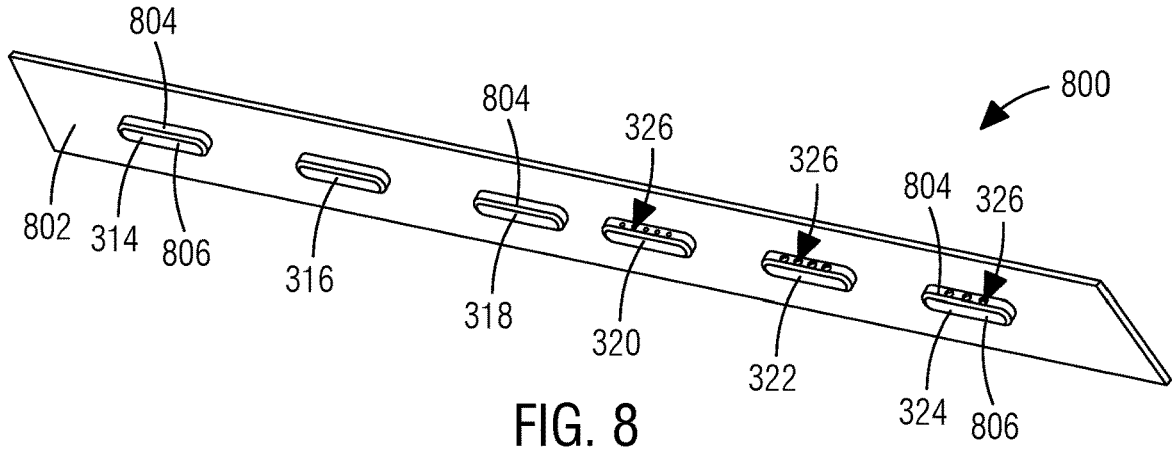
FIG. 8 a perspective view of a manifold suitable for use with the turbine blade shown in FIG. 2.

In the construction shown in FIG. 8, the manifold 800 includes a base plate 802. The base plate 802 is one single piece. The first leading compartment 314, the second leading compartment 316, the first mid compartment 318, the second mid compartment 320, the first trailing compartment 322, and the second trailing compartment 324 are formed at the base plate 802 and extend out from the base plate 802.

Each of the compartments has a compartment outer wall 804. The compartment outer wall 804 may have a compartment outer plate 806 that is spaced a non-zero distance away from the base plate 802. Apertures 326 are defined at the compartment outer wall 804. As illustrated in FIG. 8, the second mid compartment 320 has at least one aperture 326 that is formed at the compartment outer wall 804 of the second mid compartment 320. The first trailing compartment 322 has at least one aperture 326 that is formed at the compartment outer wall 804 of the first trailing compartment 322. The second trailing compartment 324 has at least one aperture 326 that is formed at the compartment outer wall 804 of the second trailing compartment 324. The apertures 326 are formed at the side plates of the compartment outer wall 804. The compartment outer walls 804 of the first leading compartment 314, the second leading compartment 316, and the first mid compartment 318 are solid.

In other constructions, the first leading compartment 314, the second leading compartment 316, and the first mid compartment 318 may have at least one aperture 326 that is formed at the compartment outer wall 804 of the respective first leading compartment 314, the second leading compartment 316, and the first mid compartment 318. It is also possible that the second mid compartment 320, the first trailing compartment 322, and the second trailing compartment 324 are solid. It is also possible that the apertures 326 are formed at the compartment outer plate 806.

Figure 9:
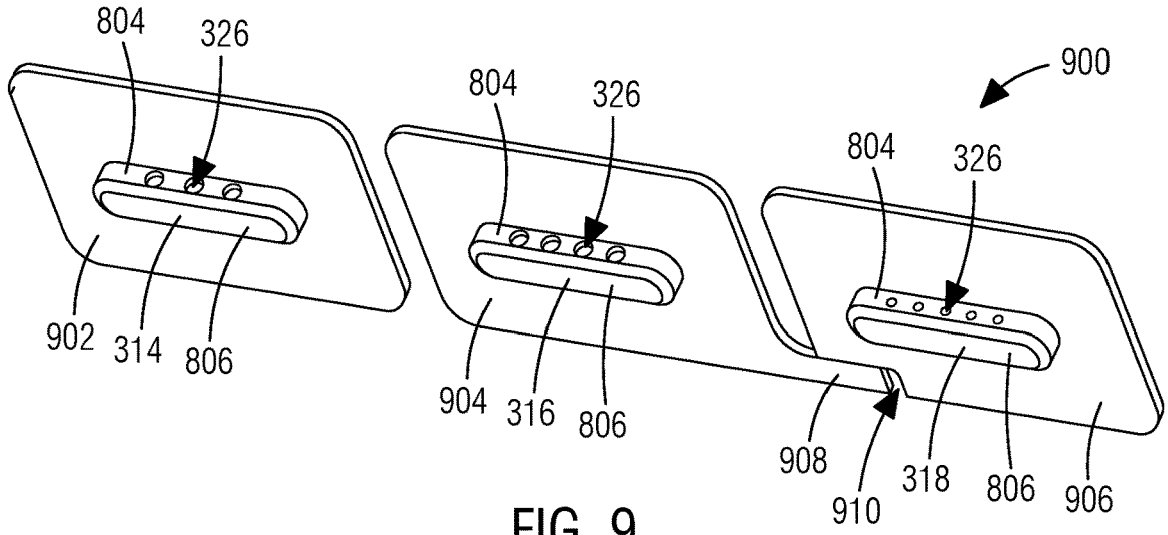
FIG. 9 a perspective view of a manifold suitable for use with the turbine blade shown in FIG. 2.

FIG. 9 illustrates a perspective view of a manifold 900 suitable for use with the turbine blade 200 shown in FIG. 2.

The manifold 900 has a plurality of base plates. The plurality of base plates are separated pieces from each other. Each of the first leading compartment 314, the second leading compartment 316, the first mid compartment 318, the second mid compartment 320, the first trailing compartment 322, and the second trailing compartment 324 is formed at one of the plurality of base plates and extends out from the respective base plate.

For example, in the construction shown in FIG. 9, the manifold 900 has a first base plate 902, a second base plate 904, and a third base plate 906. The first base plate 902, the second base plate 904, and the third base plate 906 are separated pieces. The second base plate 904 is disposed between the first base plate 902 and the third base plate 906. The second base plate 904 has an arm 908 that extends out from the second base plate 904 and engages with a recess 910 of the third base plate 906. In other constructions, the third base plate 906 may have an arm that extends out from the third base plate 906 and engages with a recess of the second base plate 904. It is also possible that the first base plate 902 has an arm that extends out from the first base plate 902 and engages with a recess of the second base plate 904, or vise verse.

The first leading compartment 314 is formed at the first base plate 902 and extends out from the first base plate 902. The second leading compartment 316 is formed at the second base plate 904 and extends out from the second base plate 904. The first mid compartment 318 is formed at the third base plate 906 and extends out from the third base plate 906. The first leading compartment 314 has at least one aperture 326 that is formed at the compartment outer wall 804 of the first leading compartment 314. The second leading compartment 316 has at least one aperture 326 that is formed at the compartment outer wall 804 of the second leading compartment 316. The first mid compartment 318 has at least one aperture 326 that is formed at the compartment outer wall 804 of the first mid compartment 318.

Further compartments, such as the second mid compartment 320, the first trailing compartment 322, and the second trailing compartment 324 may be each formed at a further base plate. It is possible that at least one of the compartment outer walls 804 is solid.

Figure 10:
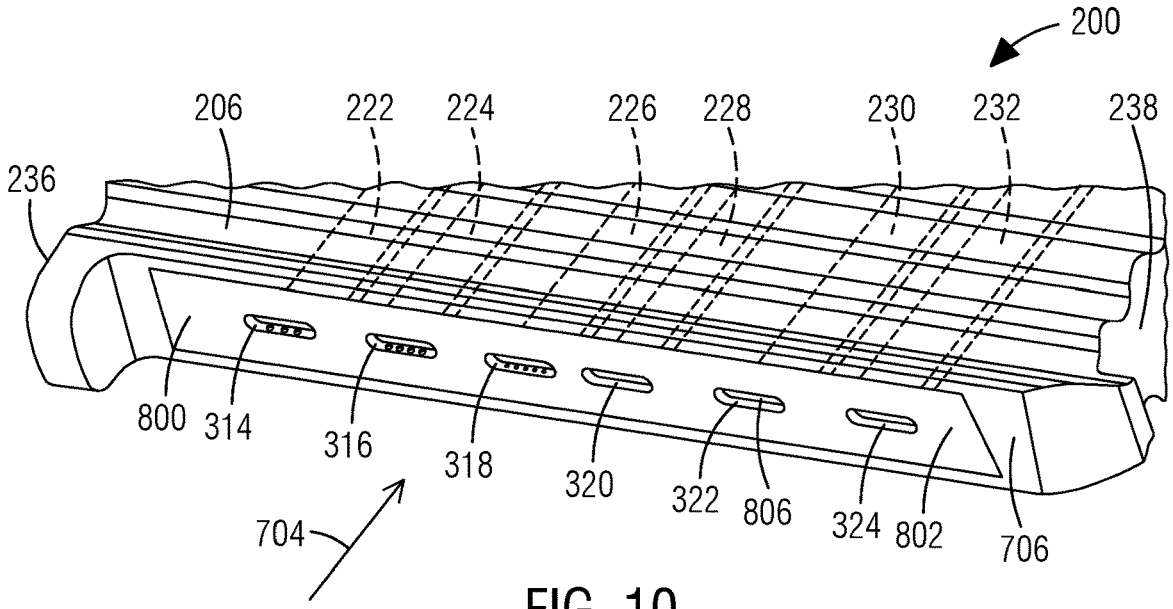
FIG. 10 is portion of a perspective view of the turbine blade shown in FIG. 2 that better illustrates the blade root and the manifold shown in FIG. 8.

FIG. 10 illustrates a portion of a perspective view of the turbine blade 200 shown in FIG. 2 that better illustrates the blade root 206 and the manifold 800.

In the construction shown in FIG. 10, the base plate 802 is attached to the blade root 206. The first leading compartment 314 is inserted into the first leading cooling passage 222. The second leading compartment 316 is inserted into the second leading cooling passage 224. The first mid compartment 318 is inserted into the first mid cooling passage 226. The second mid compartment 320 is inserted into the second mid cooling passage 228. The first trailing compartment 322 is inserted into the first trailing cooling passage 230. The second trailing compartment 324 is inserted into the second trailing cooling passage 232. The compartment outer plate 806 is spaced a non-zero distance away from the blade root end surface 706.

The manifold 800 may be replaced by the manifold 900 to be attached to the blade root 206. Each separated base plate is attached to the blade root 206 and the compartment that is formed at the base plate is inserted into one of the cooling passages. For example, the first base plate 902 is attached to the blade root 206 and the first leading compartment 314 that is formed at the first base plate 902 is inserted into the first leading cooling passage 222. The second base plate 904 is attached to the blade root 206 and the second leading compartment 316 that is formed at the first base plate 902 is inserted into the second leading cooling passage 224. The third base plate 906 is attached to the blade root 206 and the first mid compartment 318 that is formed at the third base plate 906 is inserted into the first mid cooling passage 226. Further base plates may be attached to the blade root 206 and further compartments each formed at one of the further base plates may be inserted into one of the second mid cooling passage 228, the first trailing cooling passage 230, and the second trailing cooling passage 232.

In other constructions, the manifold 800 and manifold 900 may be attached to the blade root 206 in a way such that the compartments extend out a non-zero distance away from the cooling passages, respectively.

In operation, with reference to FIG. 2 through FIG. 10, the manifolds 300, the manifold 500, the manifold 600, the manifold 800, or the manifold 900 is attached to the blade root 206 with the forward plate 308 disposed at the blade root leading edge 236 and the aft plate 310 disposed at the blade root trailing edge 238. Cooling air 704 enters the manifold and is throttled through the apertures 326 while entering. By placing the outer plate 306 or the compartment outer plate 806 away from the blade root end surface 706 with a non-zero distance, the cooling air 704 enters and is mixed in the first leading compartment 314, the second leading compartment 316, the first mid compartment 318, the second mid compartment 320, and the second trailing compartment 324 before entering the first leading cooling passage 222, the second leading cooling passage 224, the first mid cooling passage 226, the second mid cooling passage 228, and the second trailing cooling passage 232, respectively. The compartments create a plenum for the cooling air 704 before flowing into the cooling passages. The manifold is thus functioned as a flow conditioner such that the inlets of the cooling passages are shielded from throttling disturbance that may be created by the various apertures 326. The uniform and diffused cooling air 704 reduces asymmetric heat transfer.

The cooling air 704 enters the manifold 300, or the manifold 500 from the first side plate 302 and the second side plate 304 which generate effective mixing before entering the cooling passages. The cooling air 704 turns 90 degrees in the compartments and flows into the cooling passages to reduce the cooling air 704 bias from the downstream side to the upstream side.

The first leading compartment 314 meters a non-zero first flow of cooling air 704 to the first leading cooling passage 222 through the flow area of the apertures 326 in the first leading compartment 314. The second leading compartment 316 meters a non-zero second flow of cooling air 704 to the second leading cooling passage 224 through the flow area of the apertures 326 in the second leading compartment 316. The first mid compartment 318 meters a non-zero third flow of cooling air 704 to the first mid cooling passage 226 through the flow area of the apertures 326 in the first mid compartment 318. The second mid compartment 320 meters a non-zero fourth flow of cooling air 704 to the second mid cooling passage 228 through the flow area of the apertures 326 in the second mid compartment 320. The first trailing compartment 322 has no apertures 326 so that the cooling air 704 is blocked from entering the first trailing cooling passage 230. The second trailing compartment 324 meters a non-zero fifth flow of cooling air 704 to the second trailing cooling passage 232 through the apertures 326 in the second trailing compartment 324. The non-zero first flow of cooling air 704, the non-zero second flow of cooling air 704, the non-zero third flow of cooling air 704, the non-zero fourth flow of cooling air 704, and the non-zero fifth flow of cooling air 704*r* may be different from each other.

Discrete throttling control (i.e., by selecting aperture flow areas) of the flow of cooling air 704 that flows to each cooling passage is achieved by different arrangements of the compartments. In general, the flow areas of the apertures 326 in the compartments at the blade root leading edge 236 is larger than the flow areas of the apertures 326 in the compartments at the blade root trailing edge 238. For example, in manifold 300 and manifold 500, the flow area of the apertures 326 in the second leading compartment 316 and the flow area of the apertures 326 in the first mid compartment 318 is larger than the flow area of the apertures 326 in the first leading compartment 314, the flow area of the apertures 326 in the second mid compartment 320, and the flow area of the apertures 326 in the second trailing compartment 324. As such, the cooling air 704 is the least throttled in the second leading compartment 316 and the first mid compartment 318 than in the first leading compartment 314, the second mid compartment 320, and the second trailing compartment 324. The first trailing compartment 322 has no apertures 326 such that the cooling air 704 is blocked from entering the first trailing cooling passage 230.

The manifolds better controls the cooling air 704 flowing into the cooling passages which allows more accurate prediction for the life of the blade. In addition, the manifolds assist in reducing leakages of the cooling air 704.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A turbine blade comprising:

a platform defining a first side and a second side;

a blade airfoil attached to the first side of the platform, the blade airfoil comprising a pressure side wall and a suction side wall defining a blade airfoil interior;

a blade root attached to the second side of the platform, the blade root including a blade root leading edge and a blade root trailing edge with respect to a flow direction of a working flow, the blade root defining a first cooling passage and a second cooling passage that are in flow communication with the blade airfoil interior; and a manifold attached to the blade root, the manifold being non-planar, the manifold comprising:

an outer wall;

a first compartment having a first flow area defined by a first aperture, the first aperture being formed at the outer wall and open to the first compartment, the first compartment metering a non-zero first flow of cooling air to the first cooling passage through the first flow area; and a second compartment having a second flow area defined by a second aperture, the second aperture being formed at the outer wall and open to the second compartment, the second compartment metering a non-zero second flow of cooling air to the second cooling passage through the second flow area that is different than the first flow area, wherein the outer wall further comprises:

a first side plate that extends between the blade root leading edge and the blade root trailing edge;

a second side plate that extends between the blade root leading edge and the blade root trailing edge;

an outer plate that extends between the first side plate and the second side plate;

a forward plate attached to the first side plate, the second side plate, and the outer plate at one end; and an aft plate attached to the first side plate, the second side plate, and the outer plate at the other end that is opposite to the one end, wherein the outer plate is solid and spaced a non-zero distance away from a blade root end surface.

2. The turbine blade of claim 1, wherein the manifold comprises a divider plate that is disposed between the forward plate and the aft plate, and wherein the divider plate divides the manifold into the first compartment and the second compartment.

3. The turbine blade of claim 1, wherein the first aperture is formed at the first side plate.

4. The turbine blade of claim 1, wherein the first compartment comprises a plurality of first apertures that are formed at the outer wall, and wherein the plurality of first apertures define the first flow area.

5. The turbine blade of claim 1, wherein the blade root defines a third cooling passage that is in flow communication with the blade airfoil interior, wherein the manifold comprises a third compartment, wherein a portion of the outer wall that defines the third compartment is solid, and wherein the third compartment blocks the cooling air from entering the third cooling passage.

6. The turbine blade of claim 1, wherein a perimeter of the manifold defines a planar surface arranged to attach to the blade root.

* * * * *